US012612798B2

(12) United States Patent
Tsai et al.

(10) Patent No.: US 12,612,798 B2
(45) Date of Patent: Apr. 28, 2026

(54) WT-SECTION-STIFFENED STEEL PANEL DAMPER

(71) Applicant: National Applied Research Laboratories, Taipei City (TW)

(72) Inventors: Keh-Chyuan Tsai, Taipei City (TW); Wei-Dar Chen, Taipei City (TW); An-Chien Wu, Taipei City (TW)

(73) Assignee: NATIONAL APPLIED RESEARCH LABORATORIES, Taipei City (TW)

( * ) Notice: Subject to any disclaimer, the term of this patent is extended or adjusted under 35 U.S.C. 154(b) by 275 days.

(21) Appl. No.: 18/182,830

(22) Filed: Mar. 13, 2023

(65) Prior Publication Data

US 2024/0125138 A1 Apr. 18, 2024

(30) Foreign Application Priority Data

Oct. 18, 2022 (TW) ..... 111139533

(51) Int. Cl.
*E04B 1/98* (2006.01)
*E04H 9/02* (2006.01)

(52) U.S. Cl.
CPC ..... *E04H 9/0237* (2020.05); *E04H 9/021* (2013.01); *E04B 1/98* (2013.01); *E04H 9/024* (2013.01); *E04H 9/027* (2013.01)

(58) Field of Classification Search
None
See application file for complete search history.

(56) References Cited

U.S. PATENT DOCUMENTS 3,064,770 A * 11/1962 Andrews ..... B65D 90/024 52/630
4,603,531 A * 8/1986 Nash ..... B32B 7/12 428/116
5,833,873 A * 11/1998 Adonetti ..... E04G 11/10 52/630
8,327,592 B2 * 12/2012 Lafferty, III ..... E04C 2/384 52/630
8,806,833 B2 * 8/2014 Lafferty, III ..... E04H 9/16 52/630
10,184,244 B2 * 1/2019 Choi ..... E04B 1/2403
10,669,734 B2 * 6/2020 Hejazi ..... E04H 9/0215

FOREIGN PATENT DOCUMENTS

CN 108005245 A * 5/2018
JP 2000096867 A 4/2000
JP 2010229714 A * 10/2010
JP 2016069839 A 5/2016
TW 201241285 A * 10/2012
TW I532902 B * 5/2016
TW I600819 B * 1/2017
TW M538524 U * 3/2017
TW 201817941 A 5/2018

* cited by examiner

*Primary Examiner* — Phi D A
(74) *Attorney, Agent, or Firm* — MUNCY, GEISSLER, OLDS & LOWE, P.C.

(57) ABSTRACT

A steel panel damper is provided for reinforcing a building structure. The steel panel damper is disposed between a first member and an opposite second member arranged in the building structure. The steel panel damper comprises a first elastic segment, a second elastic segment, an energy dissipation segment, a first end plate, and a second end plate. In terms of the cross-sectional area perpendicular to the first direction, the first elastic segment and the second elastic segment are greater than the energy dissipation segment.

10 Claims, 7 Drawing Sheets

WT-SECTION-STIFFENED STEEL PANEL DAMPER

CROSS REFERENCE TO RELATED APPLICATION

This application claims the benefits of the Taiwan Patent Application Serial Number 111139533, filed on Oct. 18, 2022, the subject matter of which is incorporated herein by reference.

BACKGROUND OF THE INVENTION

1. Field of the Invention

The present invention relates to a steel panel damper, particularly to a steel panel damper disposed between members of a building structure.

2. Description of Related Art

Earthquakes always bring huge loss of life and property to people, so improving the seismic performance of buildings has always been one of the important topics in the development of structural engineering. Especially in the earthquake zone, earthquakes damage buildings and endanger personal and property safety. Accordingly, it is not only necessary to strengthen the strength of existing buildings, but also extremely important to strengthen the earthquake resistance of new structures to reduce disaster.

In recent years, the seismic isolation and earthquake-resistant technologies of various buildings have been continuously developed. In order to ensure the strength of the building structure can resist the horizontal external force caused by the earthquake or wind, it is necessary to have a seismic energy dissipation device in the building structure. The principle is mainly to participate in energy dissipation through these shock-absorbing and energy-dissipating devices, in order to reduce structural deformation and avoid structural damage under strong external forces.

The frame with steel shear panel damper (SPD-MRF) is a metallic-yielding seismic frame, which uses additional steel panel damper in the traditional moment-resisting frame to increase the stiffness, strength, toughness, and energy dissipation capacity. In addition, the steel panel damper is also a shear-yielding type seismic column. A conventional steel panel damper usually includes an elastic segment and an energy dissipation section, wherein the elastic segment is generally made of ordinary steel, and the energy dissipation section is made of low-yield strength steel (LYP steel). However, the cost of using low-yield strength steel is high and difficult to fabricate. Therefore, there is an urgent need for an anti-seismic system that can be conveniently constructed, has low cost, and can greatly improve the anti-seismic ability of buildings.

SUMMARY OF THE INVENTION

An objective of the present invention is to provide a steel panel damper for reinforcing a building structure. The steel panel damper is arranged between a first member and a second member of the building structure along a first direction. The steel panel damper comprises: a first elastic segment being connected to the first member of the building structure, and including a first main board and two first sideboards, wherein the first sideboards are symmetrically disposed on both sides of the first main board; a second elastic segment being connected to the second member of the building structure, and including a second main board and two second sideboards, wherein the second sideboards are symmetrically disposed on both sides of the second main board; an energy dissipation segment being disposed between the first elastic segment and the second elastic segment, and including a web and at least one stiffener, wherein the at least one stiffener is disposed on at least one surface of the web and is perpendicular to the web; a first end plate being disposed between the first elastic segment and the energy dissipation segment, perpendicularly connected to the first main board, the first sideboards, and the web; a second end plate being disposed between the second elastic segment and the energy dissipation segment, perpendicularly connected to the second main board, the second sideboards, and the web; wherein a cross-sectional area perpendicular to the first direction of the first elastic segment or the second elastic segment is greater than that of the energy dissipation segment.

In one embodiment, a stiffness and a strength of the first elastic segment and the second elastic segment are greater than that of the energy dissipation segment.

In one embodiment, a width of the first elastic segment is substantially equal to a width of the second elastic segment, and the width of the first elastic segment and the width of the second elastic segment are greater than a width of the energy dissipation segment.

In one embodiment, the first elastic segment further includes two first flanges and two first side flanges, the first flanges are perpendicular to the first main board and disposed on both sides of the first main board; one of the first side flanges is located at one side of one of the first sideboards away from the first main board, and the other one of the first side flanges is located at another side of the other one of the first sideboards away from the first main board; the second elastic segment further includes two second flanges and two second side flanges, the second flanges are perpendicular to the second main board and disposed on both sides of the second main board; one of the second side flanges is located at one side of one of the second sideboards away from the second main board, and the other one of the second side flanges is located at another side of the other one of the second sideboards away from the second main board.

In one embodiment, the energy dissipation segment further includes two energy dissipation flanges, which are perpendicular to the web and are disposed on both sides of the web.

In one embodiment, the first elastic segment, the second elastic segment, and the energy dissipation section are respectively formed from an H-shaped steel, a box-shaped steel, an L-shaped steel, an I-shaped steel, or a U-shaped steel by cutting and combining.

In one embodiment, the first elastic segment, the second elastic segment, and the energy dissipation section are formed from at least one H-shaped steel by cutting and combining.

In one embodiment, the at least one stiffener is perpendicularly connected to the first end plate and the second end plate.

In one embodiment, the at least one stiffener is parallel to the first end plate and the second end plate.

In one embodiment, the at least one stiffener is formed on the same surface or the opposite surfaces of the web of the energy dissipation segment.

In one embodiment, the at least one stiffener is connected to the web by welding.

The steel panel damper provided by the present invention can be prepared by only using common steel materials, whereas special steel materials with low yield strength is not needed, which can greatly reduce the production cost. In addition, the steel panel damper provided by the present invention are preferably connected with the upper beam and the lower beam of the structure by welding, and the first elastic segment, the energy dissipation segment, and the second elastic segment of the steel panel damper are prepared from an H-shaped steel by cutting and welding. Therefore, the preparation and assembly method of the steel panel damper of the present invention is simple, can greatly reduce the cost of preparation, increase the production rate, and the T-shaped cross-section on both sides can effectively improve the overall lateral stiffness and has a highly competitive advantage.

DETAILED DESCRIPTION OF THE PREFERRED EMBODIMENT

Figure 1:
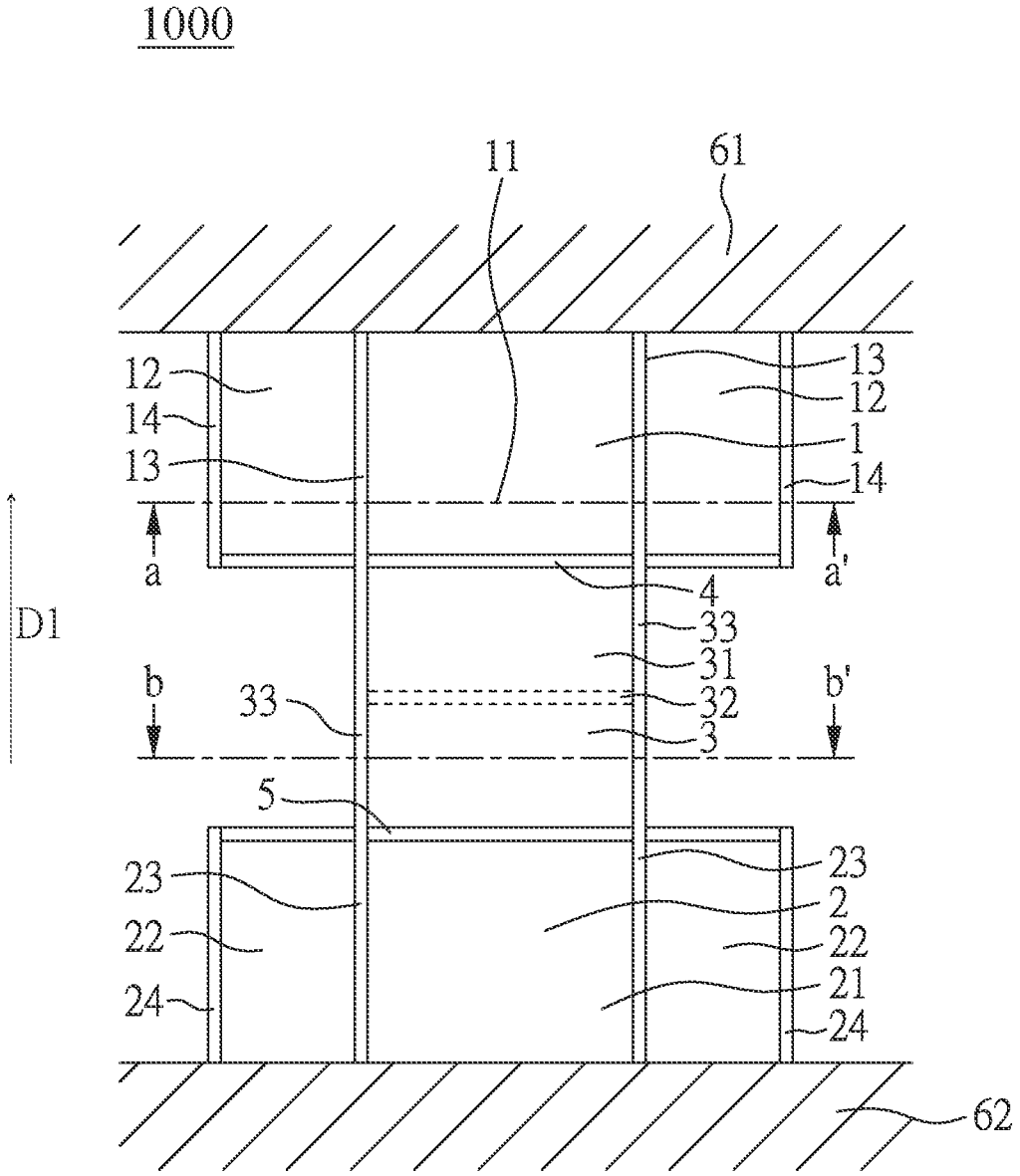
FIG. 1 is a front view of the steel panel damper of one embodiment of the present invention.
Figure 2:
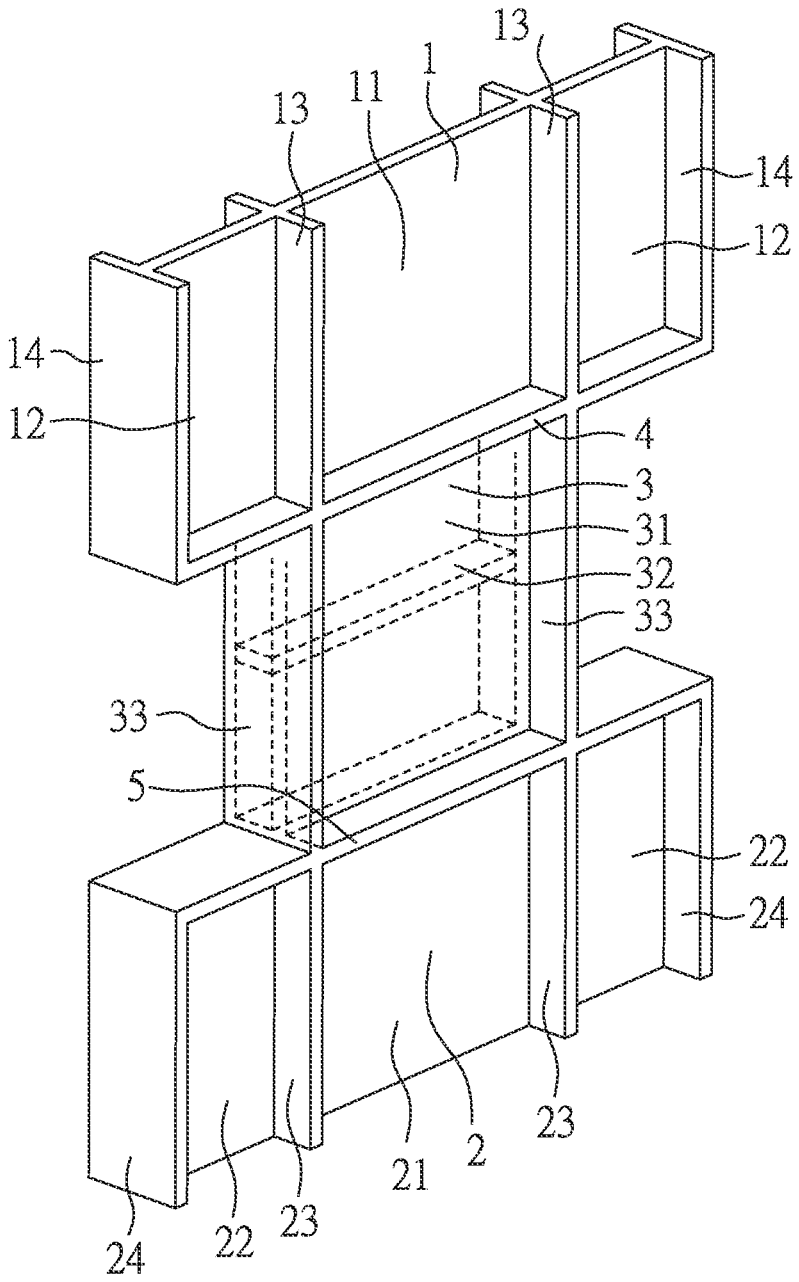
FIG. 2 is a schematic view of the steel panel damper of one embodiment of the present invention.

Reference will now be made in detail to the present embodiments of the invention, examples of which are illustrated in the accompanying drawings, and are not intended to limit the present invention, applications, or implementations described in these embodiments. Wherever possible, the same reference numbers are used in the drawings and the description to refer to the same or like parts. It shall be appreciated that, in the following embodiments and the attached drawings, elements unrelated to the present invention are omitted from depiction; and dimensional relationships among individual elements in the attached drawings are provided only for ease of understanding, but not to limit the actual scale.

[Manufacturing Method of the Steel Panel Damper]

In one embodiment of the present invention, the steel panel damper 1000 can be manufactured by cutting and welding an H-shaped steel. The detailed preparation steps are described in the following paragraphs with FIG. 3, and FIG. 4 as references.

Figure 3:
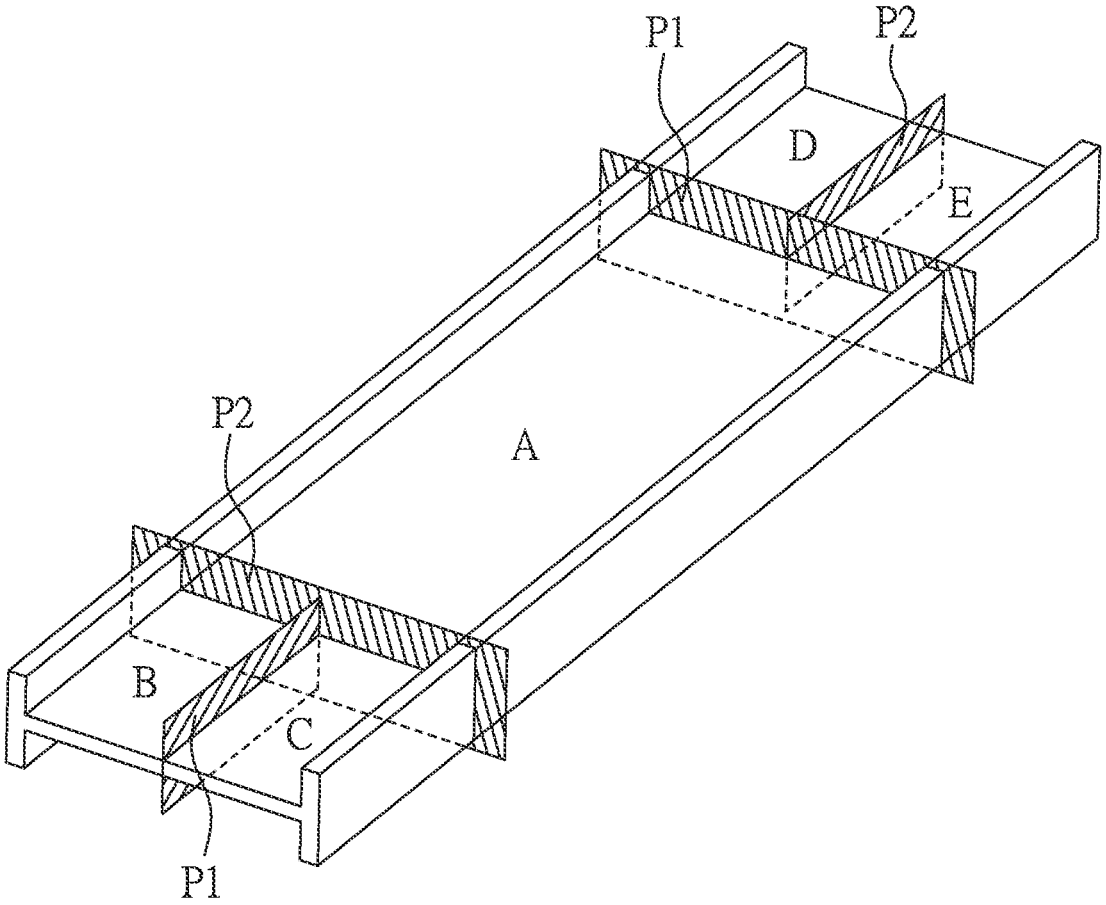
FIG. 3 is a schematic diagram of the preparation process of the steel panel damper of one embodiment of the present invention.
Figure 4:
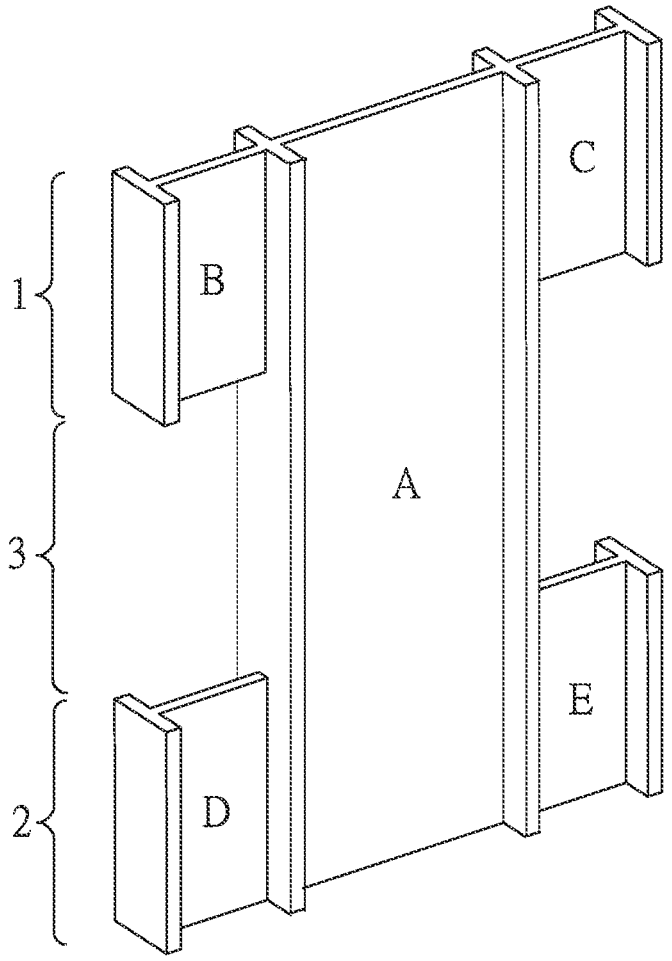
FIG. 4 is a schematic diagram of the preparation process of the steel panel damper of one embodiment of the present invention.

First, cutting an H-shaped steel along the cutting planes (P1, P2) illustrated in FIG. 3 to obtain blocks A~E. Then, as shown in FIG. 4, block B and block C are welded to both sides of the upper end of block A, block D and block E are welded to both sides of the lower end of block A. Thus, the first elastic segment 1, the second elastic segment 2, and the energy dissipation segment 3 are defined. Next, a plurality of steel plates are respectively welded between the first elastic segment 1 and the energy dissipation segment 3, between the second elastic segment 2 and the energy dissipation segment 3, and on the front surface or the back surface of the web 31 of the energy dissipation segment 3 so as to form the first end plate 4, the second end plate 5, and the stiffener 32 to complete the steel panel damper 1000 of the present embodiment.

In the steel panel damper of this embodiment, the components are all made of SN400B steel, and its dimensions are designed as shown in Table

| Components | Cross-section (mm) | Length (mm) |
|---|---|---|
| Energy dissipation flange + Web | H 512 × 202 × 12 × 22 | 750 |
| First main board + First flange | H 512 × 202 × 12 × 22 | 925 |
| First sideboard + First side flange | WT 256 × 202 × 12 × 22 | 925 |
| Second main board + Second flange | H 512 × 202 × 12 × 22 | 925 |
| Second sideboard + Second side flange | WT 256 × 202 × 12 × 22 | 925 |
| First end plate | PL 19 × 95 | 1024 |
| Second end plate | PL 19 × 95 | 1024 |
| Stiffener | PL 19 × 95 | 468 |

The steel panel damper 1000 prepared in this embodiment includes a first elastic segment 1, a second elastic segment 2, an energy dissipation segment 3, a first end plate 4, and a second end plate 5. Then, the first elastic segment 1 is connected with the first member (upper beam) 61 of a building structure by welding, and the second elastic segment 2 is connected with the second member 62 (lower beam) of the building structure by welding, so that the steel panel damper 1000 extends in a first direction D1, and the first member 61 and the second member 62 are perpendicular to the first direction D1. In other embodiments, the first elastic segment 1 and the second elastic segment 2 can also be bolted to the first member (upper beam) 61 and the second member 62 (lower beam) of the building structure respectively, which is not limited thereto.

In detail, the first elastic segment 1 includes a first main board 11, two first sideboards 12, two first flanges 13, and two first side flanges 14. The first sideboards 12 are symmetrically arranged on both sides of the first main board 11. The first flanges 13 are perpendicular to the first main board 11 and are respectively located on both sides of the first main board 11. The first side flanges 14 are respectively perpendicular to the first sideboards 12, and one of the first side flanges 14 is located on one side of one of the first sideboards 12 away from the first main board 11, and the other one of the first side flanges 14 is located on another side of the other one of the first sideboards 12 away from the first main board 11.

The second elastic segment 2 includes a second main board 21, two second sideboards 22, two second flanges 23, and two second side flanges 24. The second sideboards 22 are symmetrically arranged on both sides of the second main board 21. The second flanges 23 are perpendicular to the second main board 21 and are respectively located on both sides of the second main board 21. One of the second side flanges 24 is located on one side of one of the second sideboards 22 away from the second main board 21, and the other one of the second side flanges 24 is located on another side of the other one of the second sideboards 22 away from the second main board 21.

The energy dissipation segment 3 is located between the first elastic segment 1 and the second elastic segment 2, and includes a web 31, a stiffener 32, and two energy dissipation flanges 33.

In this embodiment, the number of the stiffener 32 is one, and the stiffener 32 is transversely arranged on one surface of the web 31 to define two rectangular blocks together with the energy dissipation flanges 33. However, in other embodiments, the number of the stiffeners 32 can be determined according to requirements and can be arranged on any surface of the web 31 horizontally or longitudinally without limitation, as long as the buckling of the energy dissipation section can be delayed. The energy dissipation flanges 33 are perpendicular to the web 31 and are located on both sides of the web 31.

The first end plate 4 is arranged between the first elastic section 1 and the energy dissipation segment 3, and perpendicularly connects to the first main board 11, the first sideboard 12, and the web 31. The second end plate 5 is disposed between the second elastic segment 2 and the energy dissipation segment 3, and perpendicularly connects to the second main board 21, the second sideboard 22, and the web 31.

Figure 5:
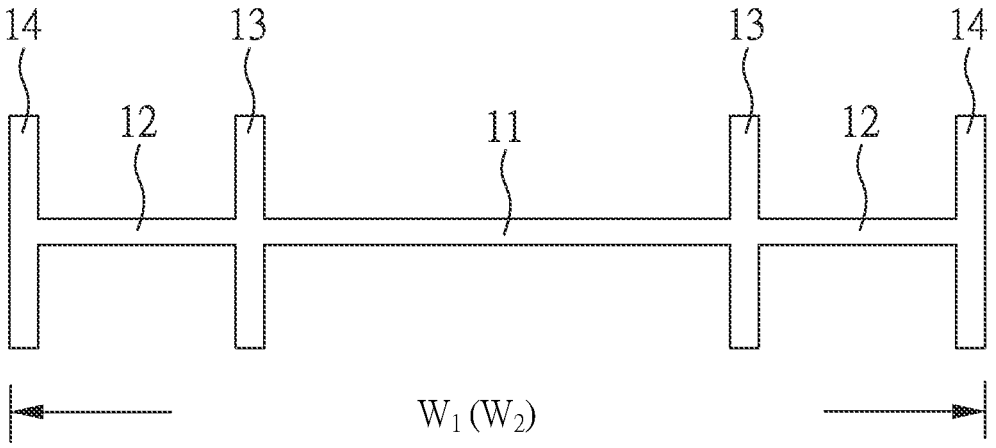
FIG. 5 is the cross-sectional view of the first elastic segment and the second elastic segment of the steel panel damper of one embodiment of the present invention.
Figure 6:
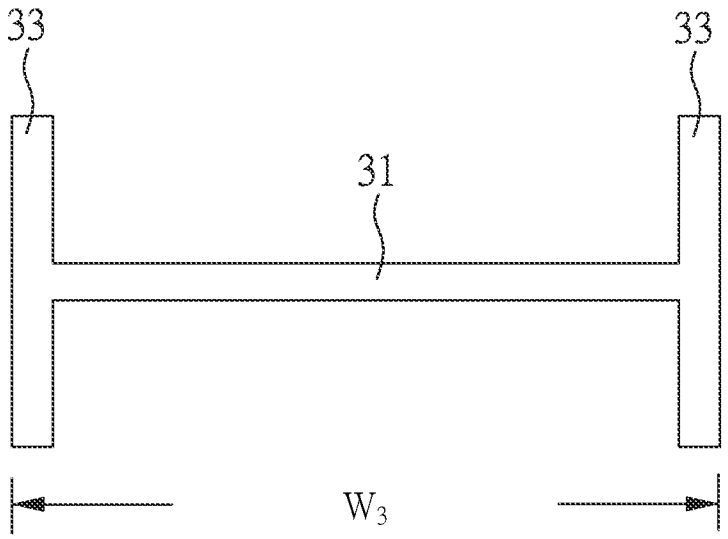
FIG. 6 is the cross-sectional view of the energy dissipation segment of the steel panel damper of one embodiment of the present invention.

Furthermore, the cross-sections of the first elastic segment 1 and the second elastic segment 2 perpendicular to the first direction D1 are shown in FIG. 5, which is the cross-section taken along the a-a' section line in FIG. 1. The cross-section of the energy dissipation segment 3 perpendicular to the first direction D1 is shown in FIG. 6, which is the cross-section taken along the section line b-b' in FIG. 1. In FIG. 5, the cross-sectional area of the first elastic segment 1 and the second elastic segment 2 are the same, and are greater than the cross-sectional area of the energy dissipation segment 3 shown in FIG. 6.

FIG. 5 and FIG. 6 also show that the width $W_1$ of the first elastic segment 1 is equal to the width $W_2$ of the second elastic segment 2, and the width $W_1$ and the width $W_2$ are greater than the width $W_3$ of the energy dissipation segment 3. In addition, the stiffness and strength of the first elastic segment 1 and the second elastic segment 2 are greater than the stiffness and strength of the energy dissipation segment 3.

However, in other embodiments, the steel panel damper can be prepared by cutting and welding box-shaped steel, L-shaped steel, I-shaped steel, or U-shaped steel, and several matching steel plates, as long as the cross-sectional area of the first elastic segment and the second elastic segment are greater than that of the energy dissipation segment, and the stiffness and strength of the first elastic segment and the second elastic segment are greater than the stiffness and strength of the energy dissipation segment.

[Test Example 1]—Cyclic Loading Test of the Steel Panel Damper

In this test example, the steel panel damper 1000 is provided in the above-mentioned embodiment as the test object, and the Multi-axial testing system (MATS) is used to carry out repeated loading tests. MATS can apply vertical force, lateral force, and toppling moment in six degrees of freedom. The loading protocol of this test is based on [AISC341-16 2016] specifications for repeated load tests on beam members, and the in-plane lateral displacement angles are: 0.375%, 0.50%, 0.75%, 1.0%, 1.5%, 2%, 3%, 4%, and 5% radians. Assuming that the height of the building is 2.6 meters, each displacement angle is performed 6, 6, 6, 4, 2, 2, 2, 2, and 2 cycles in sequence. The remaining boundary conditions are that the upper and lower ends of MATS do not rotate. During the test, the test object is in the state of axial compression of 500 kN, and the upper and lower ends of the test object have no relative displacement in the out-of-plane direction.

Figure 7:
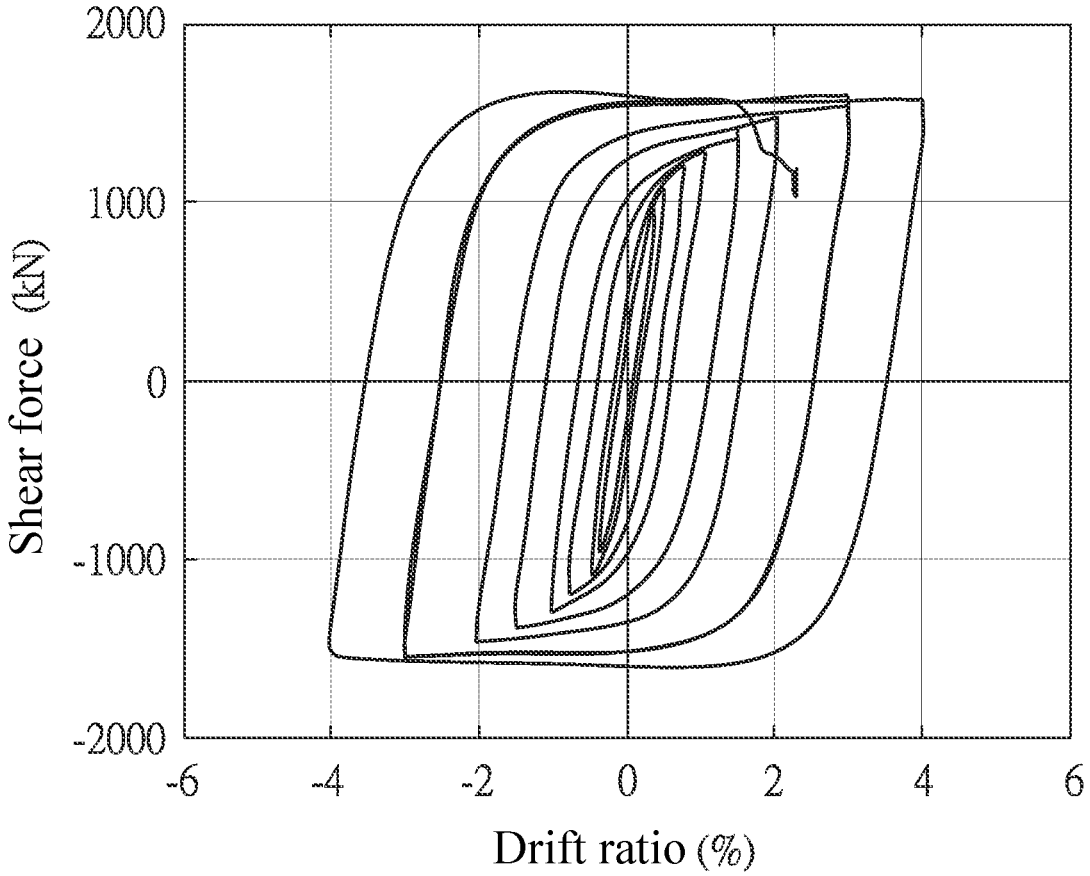
FIG. 7 is a schematic view of the test result of the test example of the present invention.

The test results of the steel panel damper 1000 provided in the above test examples are shown in FIG. 7, wherein the maximum shear deformation of the energy dissipation segment can reach 12% radians, the corresponding lateral displacement angle is 4% radians, and the cumulative plastic deformation exceeds 200 times of the amount of yield deformation. The above test results prove that the stiffeners provided by the present invention can delay the buckling of the energy dissipation segment, and the first elastic segment and the second elastic segment can maintain elastic as designed.

According to the results of this test example, it can be found that the steel panel damper designed by using the present invention has high toughness and high energy dissipation capacity. Therefore, under earthquakes, the energy dissipation segment at the core of the steel panel damper can dissipate energy through repeated inelastic shear deformation, and the stiffener disposed on the energy dissipation segment can delay the occurrence of buckling.

Although the present invention has been described in considerable detail with reference to certain embodiments thereof, other embodiments are possible. Therefore, the spirit and scope of the appended claims should not be limited to the description of the embodiments contained herein.

What is claimed is:

1. A steel panel damper for reinforcing a building structure, the steel panel damper being arranged between a first member and a second member of the building structure along a first direction, the steel panel damper comprising:

a first elastic segment being connected to the first member of the building structure, and including a first main board, two first flanges and two first sideboards, wherein the first flanges are perpendicular to the first main board and disposed on both sides of the first main board, wherein the first sideboards are symmetrically disposed on both sides of the first main board, and wherein two opposite sides of each of the first flanges are respectively connected the first main board and one of the first sideboards;

a second elastic segment being connected to the second member of the building structure, and including a second main board, two second flanges and two second sideboards, wherein the second flanges are perpendicular to the second main board and disposed on both sides of the second main board, and wherein the second sideboards are symmetrically disposed on both sides of the second main board, and wherein two opposite sides of each of the second flanges are respectively connected the second main board and one of the second sideboards;

an energy dissipation segment being disposed between the first elastic segment and the second elastic segment, and including a web, two energy dissipation flanges and at least one stiffener, wherein the two energy dissipation flanges are perpendicular to the web and are disposed on both sides of the web, and wherein the at least one stiffener is disposed on at least one surface of the web and is perpendicular to the web;

a first end plate being disposed between the first elastic segment and the energy dissipation segment, perpendicularly connected to the first main board, the first sideboards, the first flanges, the energy dissipation flanges and the web; wherein a height of each of the first sideboards is substantially equal to a height of the first main board, and two ends of the first end plate extend in a direction perpendicular to the first direction and across the first flanges and the energy dissipation flanges so as to directly connect to the first sideboards; and a second end plate being disposed between the second elastic segment and the energy dissipation segment, perpendicularly connected to the second main board, the second sideboards, the second flanges, the energy dissipation flanges and the web; wherein a height of each of the second sideboards is substantially equal to a height of the second main board, and two ends of the second end plate extend in the direction perpendicular to the first direction and across the second flanges and the energy dissipation flanges so as to directly connect to the second sideboards;

wherein a cross-sectional area perpendicular to the first direction of the first elastic segment or the second elastic segment is greater than that of the energy dissipation segment.

2. The steel panel damper of claim 1, wherein a stiffness and a strength of the first elastic segment and the second elastic segment are greater than that of the energy dissipation segment.

3. The steel panel damper of claim 1, wherein a width of the first elastic segment is substantially equal to a width of the second elastic segment, and the width of the first elastic segment and the width of the second elastic segment are greater than a width of the energy dissipation segment.

4. The steel panel damper of claim 1, wherein the first elastic segment further includes two first side flanges, one of the first side flanges is located at one side of one of the first sideboards away from the first main board, and the other one of the first side flanges is located at another side of the other one of the first sideboards away from the first main board; the second elastic segment further includes one of the second side flanges is located at one side of one of the second sideboards away from the second main board, and the other one of the second side flanges is located at another side of the other one of the second sideboards away from the second main board.

5. The steel panel damper of claim 1, wherein the first elastic segment, the second elastic segment, and the energy dissipation segment are respectively formed from an H-shaped steel, a box-shaped steel, an L-shaped steel, an I-shaped steel, or a U-shaped steel by cutting and combining.

6. The steel panel damper of claim 1, wherein the first elastic segment, the second elastic segment, and the energy dissipation segment are formed from at least one H-shaped steel by cutting and combining.

7. The steel panel damper of claim 1, wherein the at least one stiffener is perpendicularly connected to the first end plate and the second end plate.

8. The steel panel damper of claim 1, wherein the at least one stiffener is parallel to the first end plate and the second end plate.

9. The steel panel damper of claim 8, wherein the at least one stiffener is formed on the same surface or the opposite surfaces of the web of the energy dissipation segment.

10. The steel panel damper of claim 1, wherein the at least one stiffener is connected to the web by welding.

* * * * *